United States Patent [19]

Koppensteiner

[11] Patent Number: 4,512,444

[45] Date of Patent: Apr. 23, 1985

[54] ELEVATOR BUFFER

[75] Inventor: Werner Koppensteiner, Vienna, Austria

[73] Assignee: Otis Elevator Company, Farmington, Conn.

[21] Appl. No.: 484,113

[22] Filed: Apr. 11, 1983

[30] Foreign Application Priority Data

Jul. 6, 1982 [AT] Austria ..... 2614/82

[51] Int. Cl.[3] ..... B66B 5/28

[52] U.S. Cl. ..... 187/67; 187/73; 188/41

[58] Field of Search ..... 187/67, 73, 83, 84, 187/86, 88, 89, 90, 93; 188/41, 42, 43, 44, 65.1, 67

[56] References Cited

U.S. PATENT DOCUMENTS

| | | | |
|---|---|---|---|
| 1,581,458 | 4/1926 | Lindquist | 187/67 X |
| 1,803,762 | 5/1931 | Marks | 187/67 X |
| 4,069,897 | 1/1978 | Solymos | 187/67 X |

FOREIGN PATENT DOCUMENTS

| | | | |
|---|---|---|---|
| 1953867 | 6/1970 | Fed. Rep. of Germany | 187/90 |
| 2814114 | 10/1979 | Fed. Rep. of Germany | 187/67 |
| 197708 | 8/1977 | U.S.S.R. | 187/67 |

*Primary Examiner*—Joseph J. Rolla
*Assistant Examiner*—Frederick R. Handren
*Attorney, Agent, or Firm*—Robert E. Greenstien

[57] ABSTRACT

A plate is attached to a rail which moves vertically in a housing. The housing includes a brake which rubs on one side of the rail; on the other side, there is a roller. A leaf spring is positioned between the housing and the roller. When the rail moves vertically in one direction, the roller is pushed progressively harder against the rail. This squeezes the rail against the brake, creating a braking force on the rail that increases, to maximum, in relation to distance the rail moves. This arrangement may be used as a buffer for an elevator cab or counterweight in an elevator.

8 Claims, 6 Drawing Figures

ELEVATOR BUFFER

DESCRIPTION

1. Technical Field

This invention relates to elevator car and counterweight buffers.

2. Background Art

In many instances, there are code regulations relating to the construction of elevators that require installation of energy dissipating devices, known as buffers, in the pit under the car or counterweight if car speed exceeds a certain limit, e.g., 1.25 meters/second (m/s). The buffer is intended to absorb the force of the car or counterweight and bring it to a stop. For many reasons, average retardation (deceleration) should not exceed a predetermined value (e.g., 10 $m/s^2$) for peak loads, such as a full car, and, although higher peak decelerations can be tolerated, they must not last for more than a short time, for example, 40 ms., or exceed a peak level, for example, 25 $m/s^2$.

Currently used buffers are hydraulic, and typically they comprise a piston which is connected to a plate, known as the intercepting plate. As the piston moves, it forces hydraulic liquid through discharge passages with a defined diameter, a process that dissipates the kinetic energy of the car or counterweight in the internal friction associated with the flow of fluid.

But, hydraulic buffers suffer from several disadvantages. One, their operation is temperature dependent because the fluid viscosity changes with temperature. Others, hydraulic buffers are expensive and often they require routine servicing. For instance, the hydraulic fluid level must be periodically checked, because it can leak out.

DISCLOSURE OF INVENTION

It is an object of the invention to provide a buffer which is simple and inexpensive, which needs nearly no routine service and provides consistent performance over wide temperature ranges.

In accordance with the invention, a mechanical brake is used to absorb the kinetic energy, and its braking force is progressively increased with buffer stroke to provide smooth deceleration below a peak level.

In accordance with the invention, the intercepting plate is mounted on the upper end of a straight rail that can move vertically within a housing or frame. On the housing, there is a brake shoe which rubs on one side of the rail, and, also on the housing, there is a roller which forces the rail against the brake shoe when the rail moves vertically in one direction. The roller is held against the rail by a spring that is positioned relative to the roller and the rail in such a way that it provides progressively more force on the roller—therefore, more braking force—as the roller moves vertically downward, which takes place when the rail moves under a load.

In accordance with one aspect of the invention, the spring comprises a leaf spring made of perhaps one or more leafs, and the roller contains a raised rim portion. The rim is ribbed (has a roughened surface) and fits in a vertical slot in the spring, where it serves to help control horizontal roller orientation.

In accordance with another aspect of the invention, a roller stop, made of a material softer than the roller, is contacted by the roller when the buffer operates. The stop wears with repeated buffer operations, allowing the roller to move in a way that compensates for roller wear.

In accordance with another aspect, a switch is operated if the rail is below a certain height.

BEST MODE FOR CARRYING OUT THE INVENTION

Figure 1:
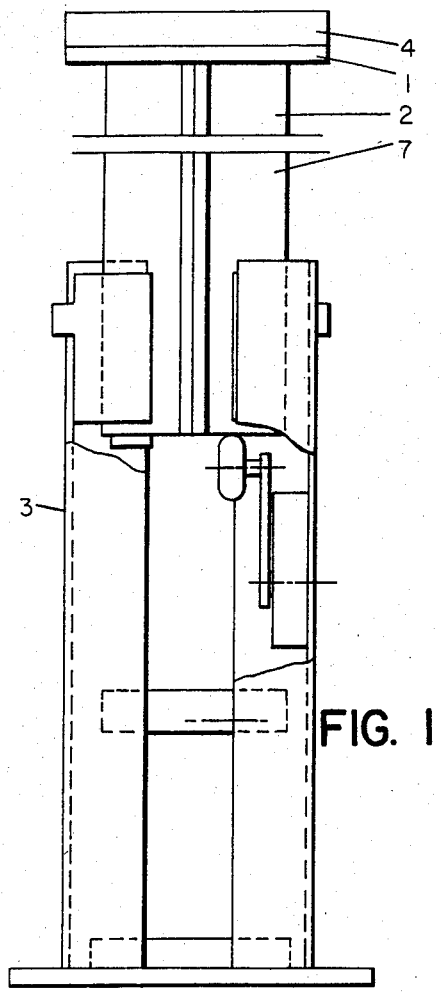
FIG. 1, a diagrammatic side elevation, shows a buffer according to the invention.
Figure 2:
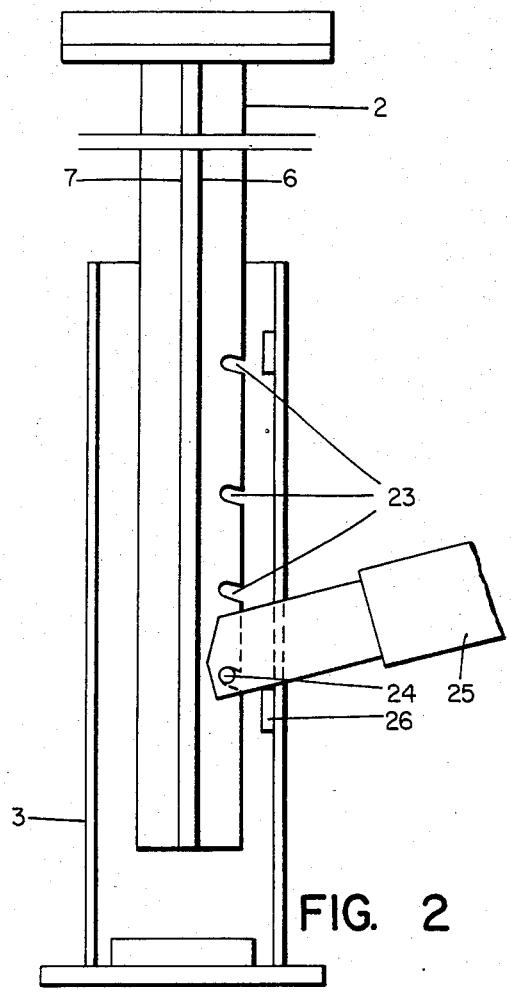
FIG. 2, another side elevation, shows the buffer as viewed in the direction of the arrow A in FIG. 1 and with one wall of the housing frame and the brake removed.
Figure 3:
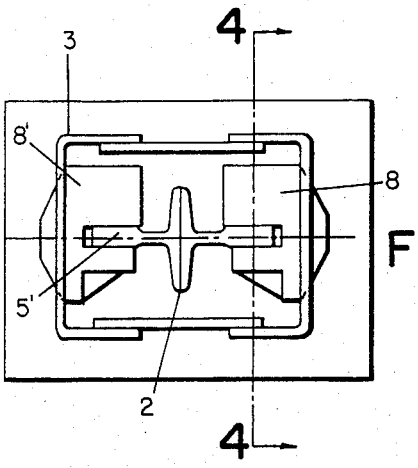
FIG. 3, a diagrammatic top plan view, shows the buffer with the intercepting plate removed.

Referring to FIGS. 1 and 2, a buffer according to the invention comprises a rail 2, which, at its upper end, is provided with a deformable intercepting plate 1. The rail is contained in a housing or frame 3, and the intercepting plate 1 is positioned below a car or the counterweight (which are shown), like a conventional hydraulic buffer. A rubber pad 4 or similar shock-absorbing surface is located on the plate.

The rail 2 consists of a double rail composed of two T-section rails which have been joined, giving the rail a cross or star shape. Each half (the shape of a T) of the rail 5' has two surfaces 6,7, and these surfaces are surrounded by a braking device 8. It is attached to the frame 3 and is stationary relative to the rail. There are two braking devices 8 and 8', one for each half of the rail.

Figure 4:
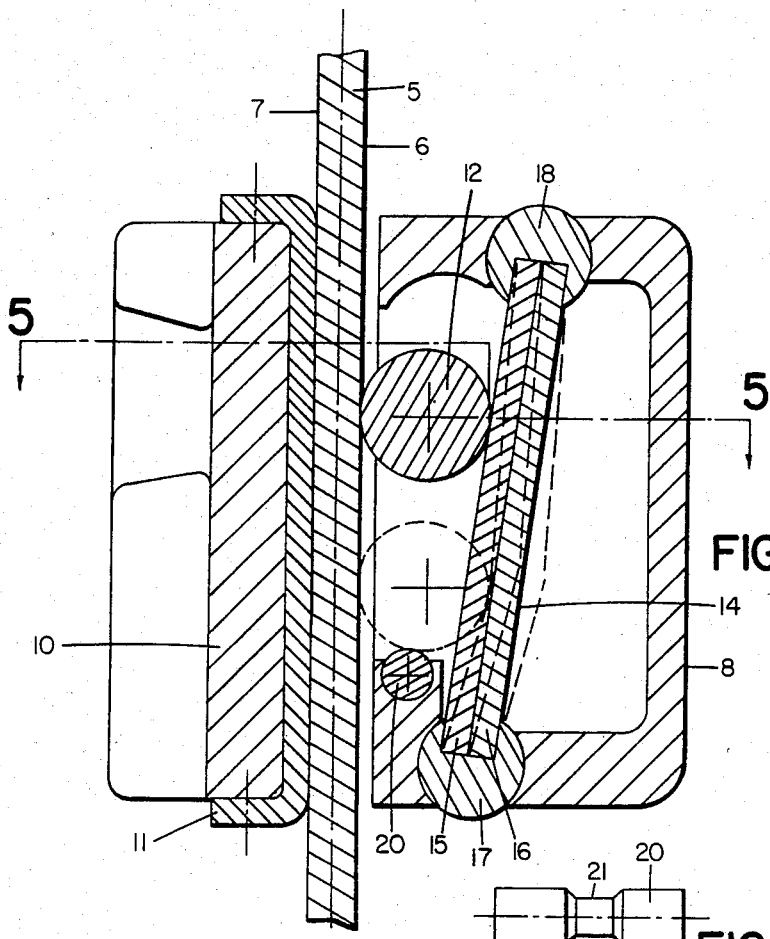
FIG. 4 is an enlarged sectional view taken on line IV—IV in FIG. 4.

FIG. 4 shows details of one of the stationary braking devices 8,8' acting like a tong or plier. A brake carrier 9 receives the portion 5 of the rail 2. A brake shoe 10, with a brake lining 11, is attached to this housing, where it faces one side 7 of portion 5. The lining may be brass. A freely rotatable (because it can roll vertically) roller 12 is mounted on the other side of portion 5, next to surface 6, and at its middle there is a slightly protruding, annular rim 13, giving it a spool shape. This rim is knurled, roughed on its peripheral surface with ribs, and the roller 12 is positioned between the surface 6 and a leaf spring 14, which, in this case, has two individual leaf springs 15,16. This spring is held, at its top and bottom ends, in rotatable holders 17,18, and, as a result, it can be displaced in the longitudinal direction relative to the holders 17,18 to the carrier 9. In other words, it can be pushed sideways (to the right) in the carrier.

Clearly apparent from FIG. 4, the upper holder 18 is spaced a larger distance from surface 6 than the lower holder 17, an orientation that gives the leaf spring 14 an upwardly inclined orientation relative to the rail surface 6, defining a "wedge-shaped" space (wider at the top than bottom) in which the roller can roll vertically.

When the buffer is at rest, the roller 12 is located as shown in FIG. 4 in the upper portion of that space. The knurled annular rib 13 protrudes freely into a groove 19 that extends from top to bottom in one spring 15. A stop 20, a brass pin (to be softer than the roller) is located at the bottom of the space, where it is firmly fitted in a slot in the frame member.

Figure 5:
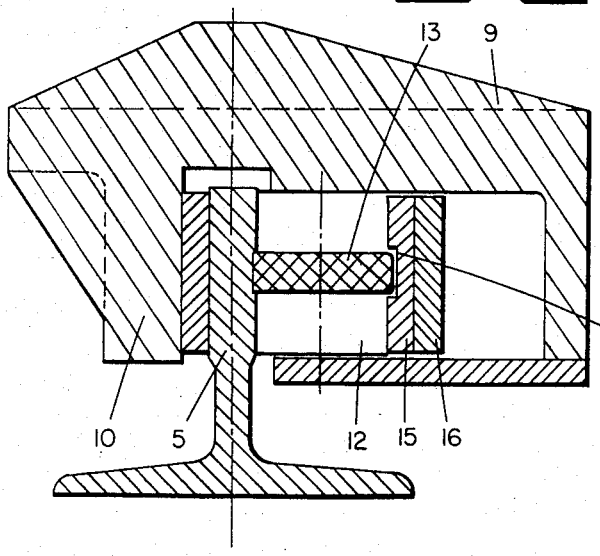
FIG. 5 is a sectional view taken on line V—V in FIG. 2.

Operation of the buffer can be explained using FIGS. 4 and 5. When the car or counterweight strikes the intercepting plate 1 (FIGS. 1 and 2), rail 2 is forced downwardly. The roller 12 is carried along by the surface 6. It rolls downward in the wedge-shaped space, in the process pushing the leaf spring 14 to the right (indicated by dotted lines), and thus being progressively pushed harder against the rail by the spring. The roller 12 finally reaches the stop 20, where it just rotates while pressing against the rail, the spring and the stop. Through this sequence, the surface 7 is forced progressively back against the brake. Progressively more (as a function of rail movement) brake force is applied to the car or counterweight until the stop is reached, and the car or counterweight, as a result, is stopped in a controlled manner. Maximum brake force is determined by the spring.

Figure 6:
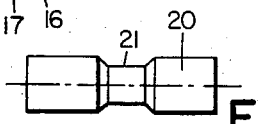
FIG. 6 shows the stop for the roller before its installation.

The rail 2, the roller 12, and the spring 14 consist of steel, and at least the surface of roller 12 should be hardened so that the knurled surface of the annular rib 13 reliably engages the surface 6. The forces are immense. Though the buffer is rarely operated, operation will result in a wear on the brake lining, the individual spring 15, and the surfaces 6 and 7. But, the brass stop 20 serves to offset that wear, because as the roller rolls on the stop, the stop is worn too, but faster, and, as a result, the roller gradually assumes a lower position, maintaining a constant brake pressure. Knurled rib or rim portion 13 of the roller 12 is received in an annular slot 21 of brass stop 20 as shown in FIG. 6.

In FIG. 1, where the buffer is shown in its initial position, a safety switch 27 is deployed to disable the elevator control system if the buffer is not in its initial position.

When the buffer has been actuated, the profiled rail 2 may be clamped rather tightly in the braking device 8. To permit a convenient release, the rail 2 has slots 23 that are intended to receive a pin 24 on a releasing tool lever 25. To release and raise the rail, the tool 25 is first inserted through openings (not shown) in the housing, and then, while supporting it on pivot bars or posts 26 that are secured to the housing frame, the tool is pushed down to "lever" the rail up to its initial position. The action is much like the operation of an automobile jack.

In addition to any mentioned modifications and variations to the invention, the previous description will suggest, to one skilled in the art, other modifications and variations embraced by the true scope and spirit of the invention.

I claim:

1. For use in stopping an elevator car or counterweight, a buffer, characterized by:

(a) a strike plate mounted on a rail;

(b) a housing in which the rail slides vertically;

(c) a brake assembly attached to the housing for providing stopping force upon the rail when the rail moves in one direction, said assembly comprising;

(d) a brake shoe on one side of the rail;

(e) a roller on the other side of the rail;

(f) a resilient member on the other side of the rail that forces the roller against the rail, said resilient member being located relative to the rail, to force the rail progressively harder against said shoe as the rail moves in said one direction.

2. The buffer described in claim 1, characterized in that:

the resilient member is leaf-spring oriented to present progressively smaller space between the spring and the rail in said one direction;

the roller is located between the spring and the roller and can move in said one direction in response to rail movement.

3. The buffer described in claim 2, characterized in that:

the leaf spring comprises two adjacent springs.

4. The buffer described in claim 2, characterized by:

a roller stop located at the lowest position between the spring and the rail and made of material softer than the roller.

5. The buffer described in claim 2, characterized in that:

the spring contains a vertical slot; and the roller contains a ribbed rim portion which moves in the slot as the roller moves and which contacts the rail and the stop.

6. The buffer described in claim 5, characterized by:

a roller stop which is located at the lowest position between the spring and the rail, made of material softer than the roller, and contains a slot to receive the rim portion of the roller.

7. The buffer described in claim 1, characterized in that:

the rail contains vertical slots for raising the rail with a lever extended through the housing.

8. The buffer described in claim 7, characterized in that:

a switch is located in the housing and positioned to be operated from a first state to a second state in response to movement of the rail.

* * * * *